US011074895B2

(12) United States Patent
Grant

(10) Patent No.: US 11,074,895 B2
(45) Date of Patent: Jul. 27, 2021

(54) NECK COVER FOR A STRINGED MUSICAL INSTRUMENT

(71) Applicant: Adam Grant, West Hollywood, CA (US)

(72) Inventor: Adam Grant, West Hollywood, CA (US)

( * ) Notice: Subject to any disclaimer, the term of this patent is extended or adjusted under 35 U.S.C. 154(b) by 0 days.

(21) Appl. No.: 17/204,686

(22) Filed: Mar. 17, 2021

(65) Prior Publication Data

US 2021/0201858 A1 Jul. 1, 2021

Related U.S. Application Data

(60) Provisional application No. 63/145,455, filed on Feb. 3, 2021.

(51) Int. Cl.
*G10D 3/18* (2020.01)
*G10G 7/00* (2006.01)

(52) U.S. Cl.
CPC ..... *G10D 3/18* (2013.01); *G10G 7/00* (2013.01)

(58) Field of Classification Search
CPC ..... G10D 3/18; G10G 7/00
See application file for complete search history.

(56) References Cited

U.S. PATENT DOCUMENTS 4,121,494 A * 10/1978 Reno ..... G10G 7/00 84/453
2005/0145095 A1* 7/2005 Larry ..... G10G 7/00 84/453
2013/0312586 A1* 11/2013 Brunnemer ..... G10G 7/005 84/453

* cited by examiner

*Primary Examiner* — Jianchun Qin
(74) *Attorney, Agent, or Firm* — Barry Choobin; Patent 360

(57) ABSTRACT

A utility article for protecting and covering the strings of a musical instrument, while providing options for visibility and display. The utility article, including a covering member made of flexible material and having a front side and a rear side. Four flaps extend from the left edge and the right edge of the covering member, wherein two flaps extend outwards to form a sleeve and the two flaps extend rearwards wrapping the neck of the musical instrument. The two pockets will serve for holding the users common accessories and tools, while an attachable flap will allow the device to second as a guitar strap when not in its primary use.

18 Claims, 6 Drawing Sheets

NECK COVER FOR A STRINGED MUSICAL INSTRUMENT

CROSS-REFERENCE TO RELATED APPLICATIONS

This application claims priority to the U.S. provisional patent application Ser. No. 63/145,455, filed on Feb. 3, 2021, which is incorporated herein by reference in its entirety.

FIELD OF INVENTION

The present invention relates to a protective neck cover for a musical instrument, and more particularly, the present invention relates to a utility article for covering strings of a stringed musical instrument.

BACKGROUND

Stringed musical instruments, such as a guitar, generally include an elongated neck and a continuous body. Multiple strings extend along the length of the stringed instrument. It is desirable to cover the strings to protect against both physical and environmental damage Covers for musical instruments are known in the art including stringed musical instruments. Such covers can protect musical instruments from both physical and environmental damage, including but not limited to dust and rust. Also, such covers can have a handle to pick and carry the musical instrument. However, the known instrument covers completely cover the musical instrument, and are bulky. A user may desire to only cover the parts of the musical instrument that are prone to damage and rust, such as the strings and display the aesthetic body of the instrument.

Thus, a long-term desire is there for a utility article for stringed musical instruments that can selectively cover and protect the strings.

Hereinafter the stringed musical instrument is interchangeably referred to as musical instrument, stringed instrument and includes guitars, electric guitars, acoustic guitars, mandolins, banjos, violins, violas, and cellos.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

It is therefore the principal object of the present invention directed to a utility article for protecting strings of a musical instrument.

It is still another object of the present invention that the utility article selectively covers the strings.

It is a further object of the present invention that the utility article is made of a soft microfiber material that prevents any scratches on the musical instrument but protects from the elements, such as sunlight, dust buildup, and rust and the users can enjoy the protection of fresh strings.

It is yet another object of the present invention that the utility article can be used to store small objects and double as a guitar strap.

It is still a further object of the present invention that the utility article is compact and light in weight.

It is an additional object of the present invention that the utility article can be rolled for storage.

It is still an additional object of the present invention that the utility article is economic to manufacture.

It is yet another object of the present invention that the utility of it seconding as a guitar strap through use of an added-on connector flap included with the product.

In one aspect, disclosed is a utility article for protecting and covering a string portion of a musical instrument. It can fold to cover half the fret board or the entire length of the guitar, depending on the users display preferences. The disclosed utility article including a covering member made of flexible material and having a front side and opposite rear side. The length of the covering member can be proportional to the length of the string portion of the musical instrument. The width of the covering member can be proportional to the width of the string portion or neck of the musical instrument. The covering member can have a left edge, a right edge, a top edge, and a bottom edge. The covering member can have a neck portion adapt to cover the string portion along the neck of the musical instrument and a body portion adapted to cover the string portion along the body of the musical instrument. The bottom surface of the covering member can be made of microfiber or similar soft material that may not cause scratch the surface of the musical instrument.

In one aspect, the disclosed utility article further includes a pair of flaps i.e., the first flap and the second flap. The first flap extends from the left edge and the second flap extends from the right edge of the covering member. The length of the first flap and the second flap can be proportional to the length of the neck portion of the covering member. The first flap is configured to couple with the second flap to form a sleeve.

In one aspect, the disclosed utility article further includes a second pair of flaps that extends rearward i.e., towards the rear side of the covering member. The second pair of flaps including the third flap and the fourth flap extends from the left edge and the right edge of the neck portion and configured to wrap around the neck of the musical instrument. The third flap and the fourth flap can couple using a hook and loop fastener.

In one aspect, the first flap or the second flap are having one or more pockets for storing small objects.

In one aspect, the first flap or the second flap are having two pockets of which at least one pocket is having a zipper.

In one aspect, the body portion of the covering member can fold over the neck portion and retain by the first flap coupled with the second flap.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
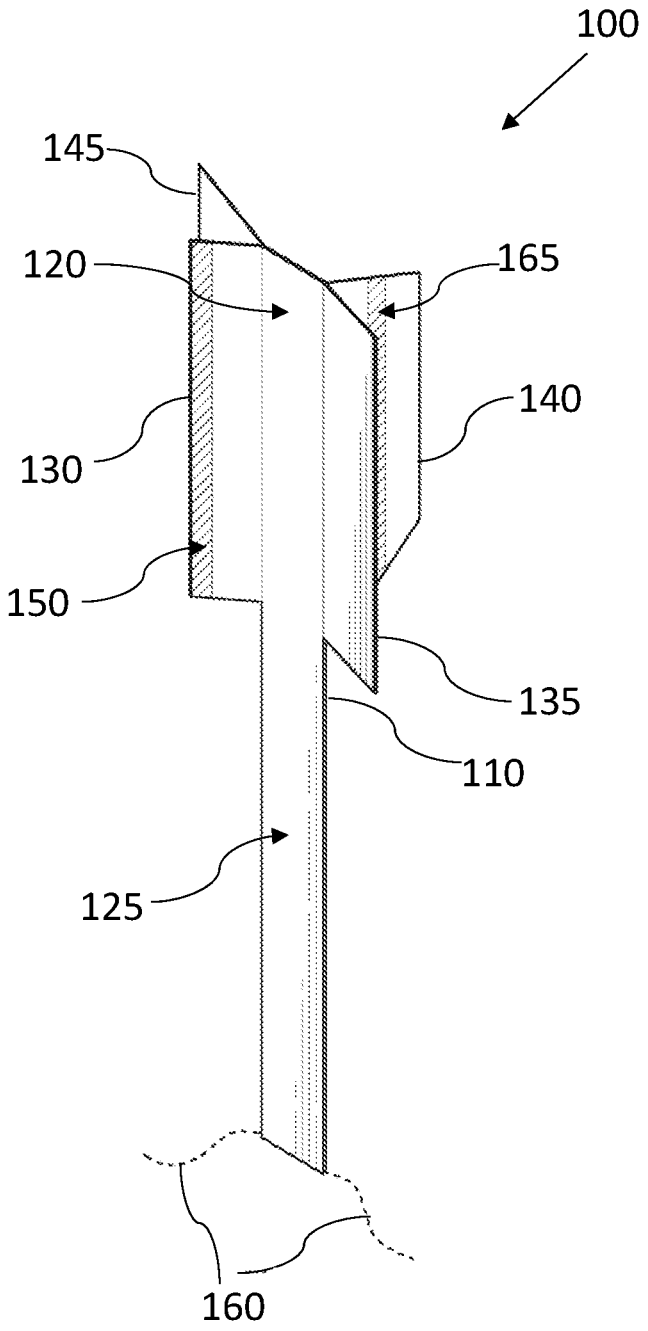
FIG. 1 is a perspective view of the utility article for covering the string portion of the musical instrument, according to an exemplary embodiment of the present invention.
Figure 2:
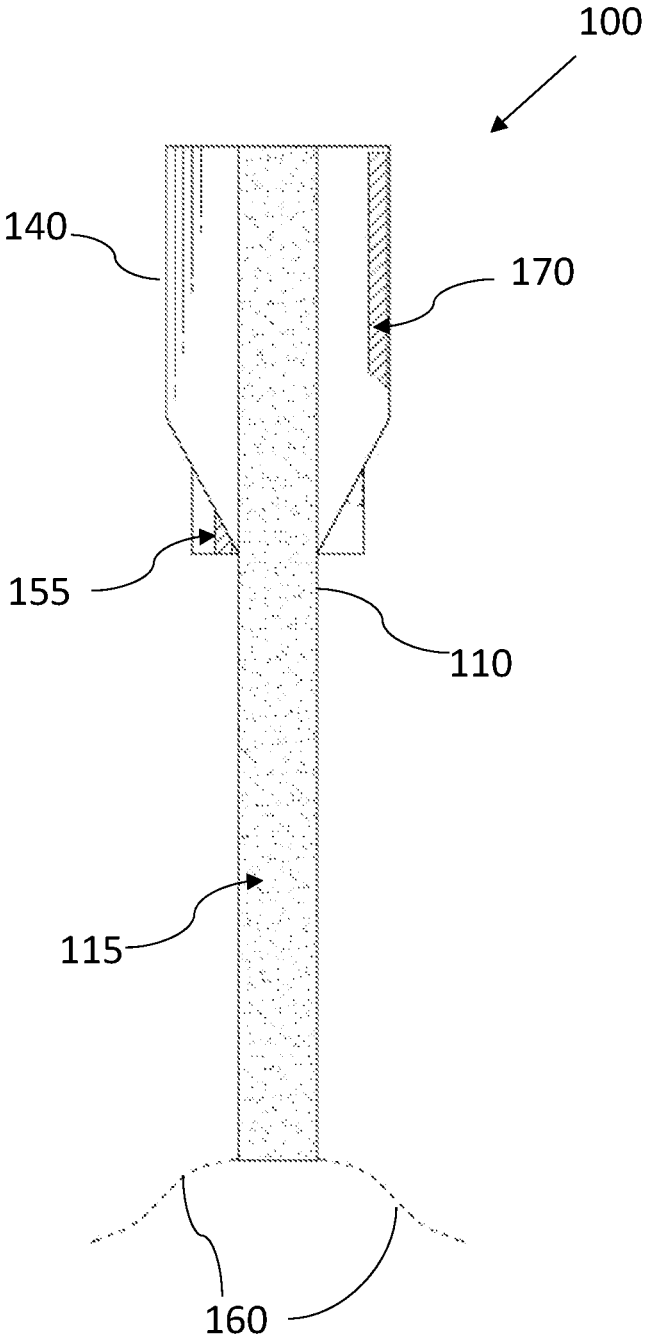
FIG. 2 shows the rear side of the utility article shown in FIG. 1 having a layer of microfiber material, according to the exemplary embodiment of the present invention.
Figure 3:
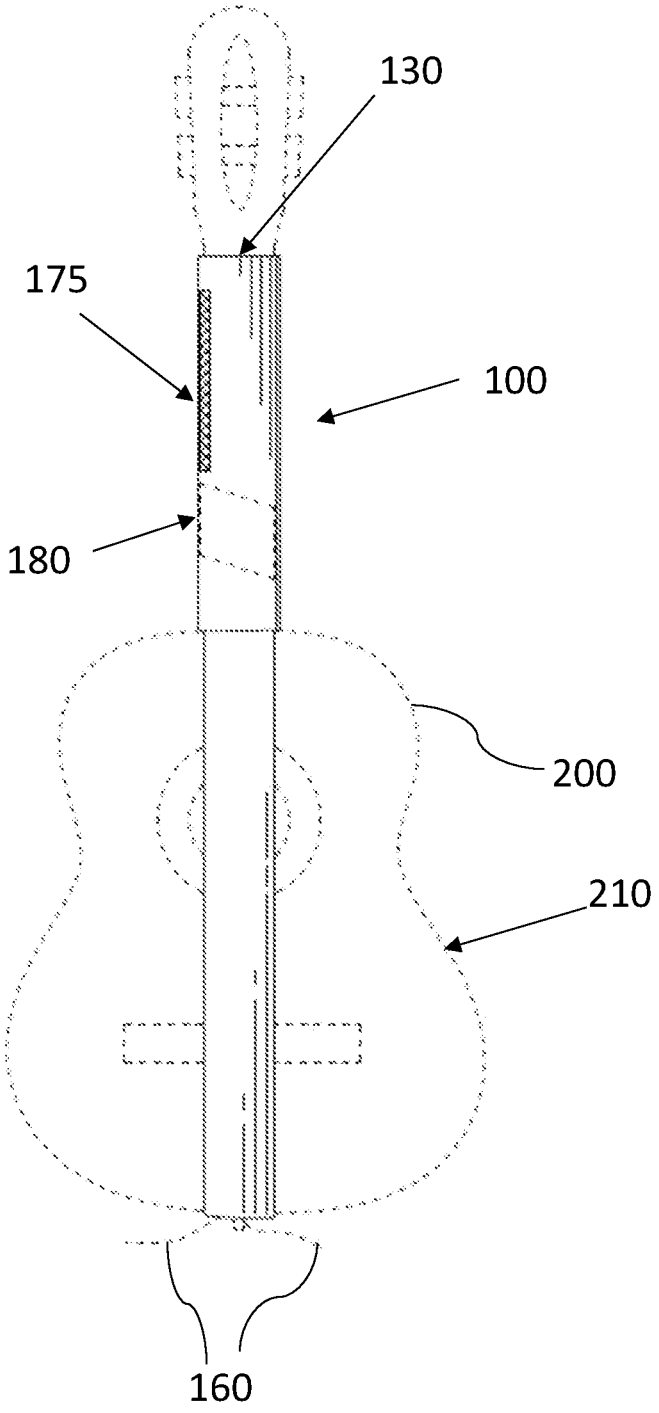
FIG. 3 shows the utility article installed on a guitar, according to the exemplary embodiment of the present invention.

Disclosed is a utility article for covering a string portion of a musical instrument. The stringed instrument having a neck and a body, wherein the strings extend from the neck to the body along the length of the musical instrument. Referring to FIG. 1 which shows an exemplary embodiment of the utility article 100. The disclosed utility article 100 having a covering member 110. The covering member can be made of flexible material such as fabric, polyester, plastics, and like. The covering member having a front side and a rear side. The rear side 115 of the covering member 110 is shown in FIG. 2, wherein the stippling shows the microfiber cloth. The rear side of the covering member juxtaposes the strings and the portions of the stringed instrument. The rear side of the covering member can have a layer of a soft material that may not scratch the surface of the musical instrument. The covering member can have a left edge, a right edge, a top edge, and a bottom edge. The left edge and the right edge are along the length of the covering member. The covering member can be assumed to be divided into two portions i.e., the neck portion 120 and the body portion 125. The neck portion covers the neck of the musical instrument while the body portion covers the body. FIG. 3 shows the guitar 200 having a neck (covered by the utility article) and a body 210.

The utility article 100 having four flaps including a first flap 130, a second flap 135, a third flap 140, and a fourth flap 145. The length of the four flaps can be the same or less than the length of the neck portion 120 of the covering member 110 or the neck of the stringed instrument. The first flap and the second flap form the first pair of flaps that extends upwards towards the front side of the covering member. The first flap extends from the left edge and the second flap extends from the right side of the covering member. The first flap and the second flap can have a fastening member that allows the first flap to couple with the second flap to form a sleeve. The first flap and the second flap folds over the front side of the covering member as shown in FIG. 3. Only the first flap 130 is visible which is covering the second flap 135. An additional, detachable flap will connect to the underbelly of flap visible in 130 to attach the device to the neck's guitar strap button. The first flap is having a first member 150 of the hook and loop fastener. The second member 155 of the hook and loop fastener can be provided on the second flap (shown in FIG. 2). The second member 155 of the hook and loop fastener is along the inner edge while the first member of the hook and loop fastener is on the outer edge.

Figure 4:
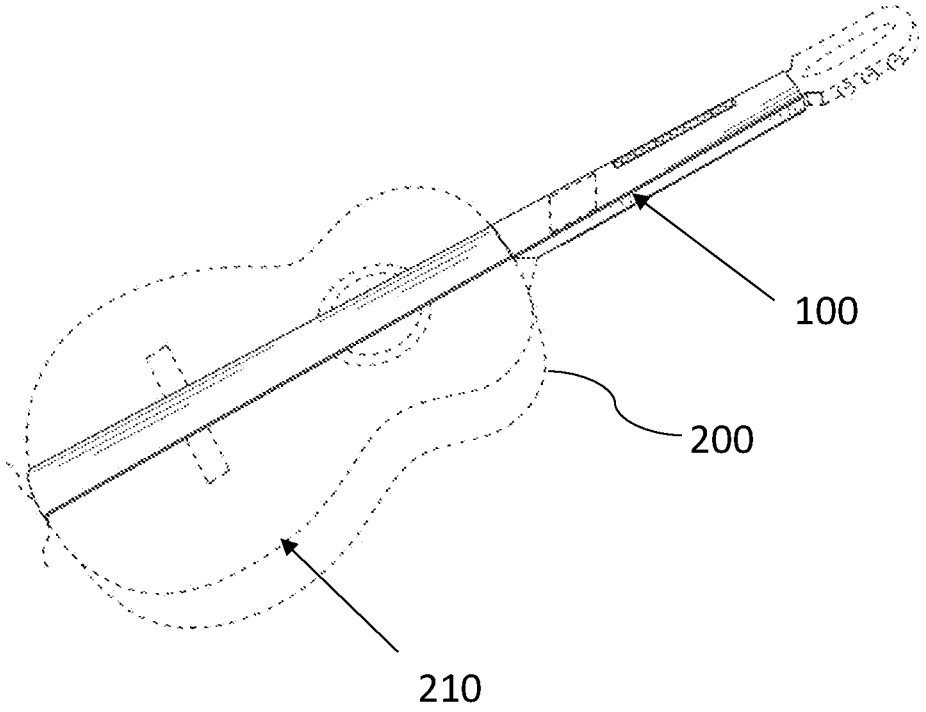
FIG. 4 shows a perspective view of the image shown in FIG. 3, according to the exemplary embodiment of the present invention.
Figure 5:
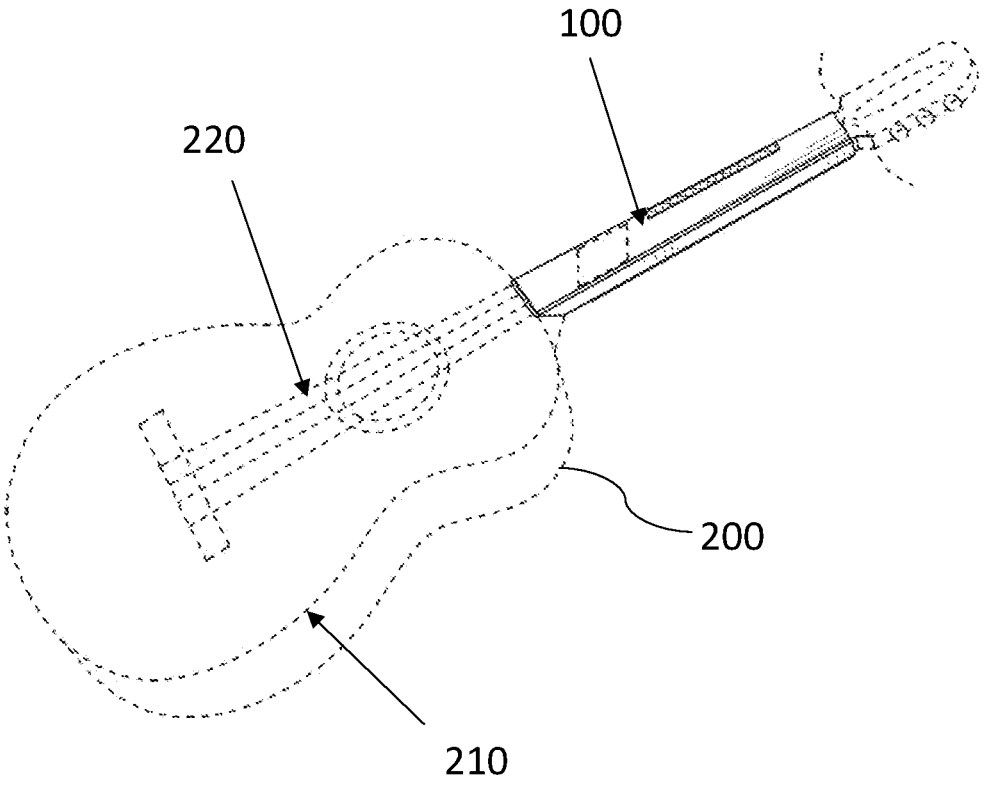
FIG. 5 shows the body portion of the covering member folded over its neck portion, according to the exemplary embodiment of the present invention.

The body portion of the covering member can fold over its neck portion. The body portion can be folded upwards to rest against the front side of the neck portion. Thereafter, the first flap can be coupled to the second flap to retain the body portion of the covering member folded over its neck member. FIG. 4 shows the covering member 110 applied over the string portion of the guitar. The covering member can be seen extended from the start of the neck portion upwards to the bottom edge of the body of the guitar and thereafter folds inwards. The bottom edge of the covering member can have two cords 160 that can be fastened to the bottom of the guitar for securing the covering member to the guitar. This will also serve as the second attachment to the guitar for the body strap button. The first pair of flaps are shown folded in FIG. 3 and FIG. 4. FIG. 5 shows the body portion of the covering member folded over the neck portion and retained by the first pair of flaps.

Figure 6:
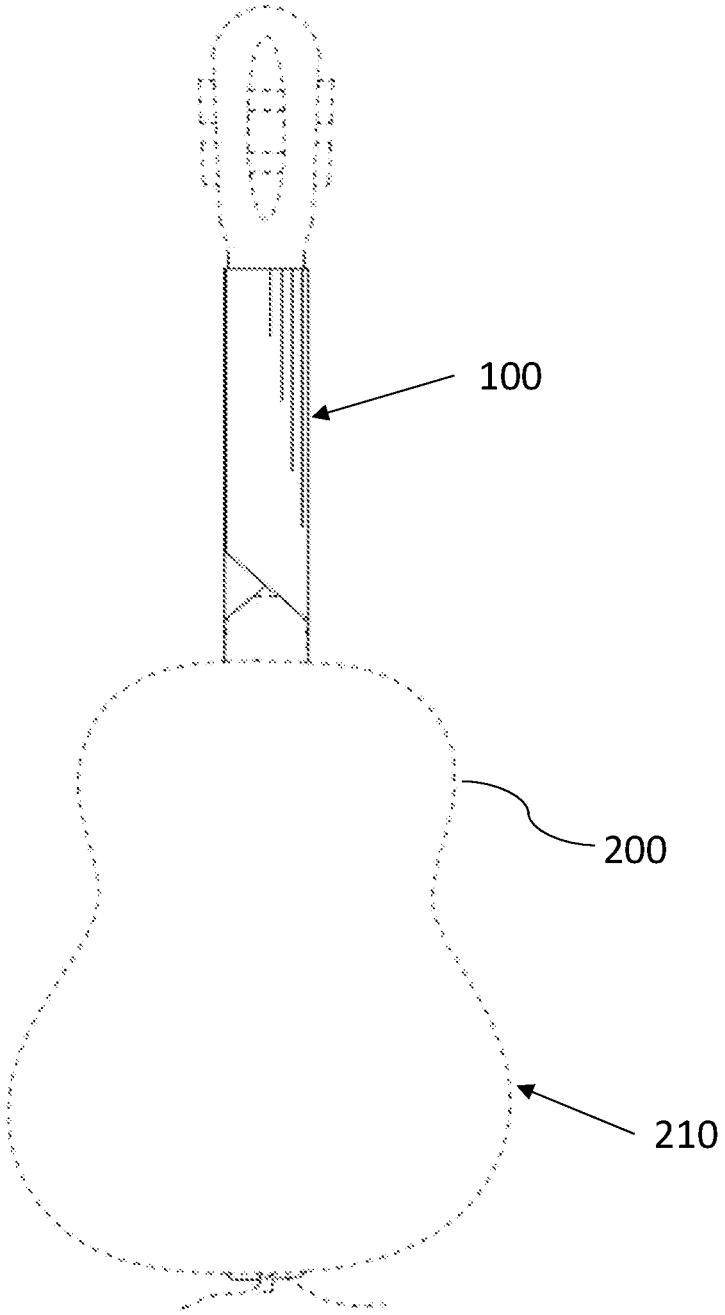
FIG. 6 is the rear side of the guitar shown in FIG. 4 having the flaps of the utility article wrapped over the neck of the guitar, according to the exemplary embodiment of the present invention.

Referring again to FIG. 1, the third flap 140 and the fourth flap 145 forms a second pair of flaps that can be wrapped around the neck of the guitar. The third flap and the fourth flap can fold over the neck of the guitar as shown in FIG. 6. The third flap extends from the right edge while the fourth flap extends from the left edge of the covering member. The third flap and the second flap extend rearwards and opposite to the first pair of flaps. The third flap and the fourth flap can also have suitable fasteners for coupling the third flap with the fourth flap. The fastener can be a hook and loop fastener. FIG. 1 shows the third flap 140 having the first part 165 of the hook and loop fastener while FIG. 2 shows the fourth flap 145 having the second part of the hook and loop fastener.

Referring to FIG. 3 can be seen a first pocket 175 and a second pocket 180. The pockets can be provided for storing small objects, such as guitar pick or plectrum and capo, which can be stored in the second pocket 180. FIG. 3 shows the pockets made in the first flap 130 that opens at the inner edge of the first flap. The first pocket can have a closure such as a zipper.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A utility article for covering a string portion of a stringed musical instrument, the utility article comprising:

a covering member made of a flexible material, the covering member having a length and width proportional to a length and width of the string portion, the covering member having a neck portion adapted to cover a neck area of the string portion and a body portion adapted to cover a body area of the string portion, the covering member having a front side and a rear side, the covering member having a left edge, a right edge, a top edge, and a bottom edge;

a first flap and a second flap extending from the left edge and the right edge of the neck portion outwards and towards the front side of the covering member; and a third flap and a fourth flap extend from the left edge and the right edge of the covering member rearwardly and opposite to the first flap and the second flap, the third flap and the fourth flap adapted to wrap over a neck of the stringed musical instrument for securing the utility article to the stringed musical instrument.

2. The utility article according to claim 1, wherein the rear side of the covering member is of a microfiber cloth.

3. The utility article according to claim 1, wherein the bottom edge of the cover member is having a pair of cords, the pair of cords configured to fasten to the bottom of the stringed musical instrument's strap button.

4. The utility article according to claim 1, wherein the stringed musical instrument is a guitar.

5. The utility article according to claim 1, wherein the first flap and the second flap are having a fastener for coupling the first flap with the second flap.

6. The utility article according to claim 5, wherein the third flap and the fourth flap are having a second fastener for coupling the third flap with the fourth flap.

7. The utility article according to claim 6, wherein the second fastener is a hook and loop fastener.

8. The utility article according to claim 1, wherein the fastener is a hook and loop fastener.

9. The utility article according to claim 1, wherein the utility article is further having one or more pockets configured in the first flap, the second flap, the third flap, or the fourth flap.

10. The utility article according to claim 1, wherein the utility article is having two pockets in the first flap, one of the two pockets is having a zipper at its opening.

11. A utility article for covering a string portion of a stringed musical instrument, the utility article comprising:

a covering member made of a flexible material, the covering member having a length and width proportional to a length and width of the string portion, the covering member having a neck portion adapted to cover a neck area of the string portion adjacent a neck of the stringed musical instrument and a body portion adapted to cover a body area of the string portion adjacent a body of the stringed musical instrument, the covering member having a front side and a rear side, the covering member having a left edge, a right edge, a top edge, and a bottom edge; and a third flap and a fourth flap extend from the left edge and the right edge of the covering member rearwardly, the third flap and the fourth flap adapted to wrap over the neck of the stringed musical instrument for securing the utility article to the stringed musical instrument;

wherein the body portion of the covering member configured to be folded over the front side of the neck portion, the utility article further comprises a retention member coupled to the covering member and configured to secure the body portion over the neck portion.

12. The utility article according to claim 11, wherein the rear side of the covering member is of a microfiber cloth.

13. The utility article according to claim 11, wherein the third flap and the fourth flap are having a fastener for coupling the third flap with the fourth flap.

14. The utility article according to claim 13, wherein the fastener is a hook and loop fastener.

15. A method for protecting a string portion of a stringed musical instrument, the method comprising the steps of:

providing a utility article, the utility article comprising:

a covering member made of a flexible material, the covering member having a length and width proportional to a length and width of the string portion, the covering member having a neck portion adapted to cover a neck area of the string portion and a body portion adapted to cover a body area of the string portion, the covering member having a front side and a rear side, the covering member having a left edge, a right edge, a top edge, and a bottom edge, a first flap and a second flap extending from the left edge and the right edge of the neck portion outwards and towards the front side of the covering member, and a third flap and a fourth flap extend from the left edge and the right edge of the covering member rearwardly and opposite to the first flap and the second flap, the third flap and the fourth flap adapted to wrap over a neck of the stringed musical instrument for securing the utility article to the stringed musical instrument; and wrapping the third flap and the fourth flap to the neck of the stringed musical instrument.

16. The method according to claim 15, wherein the third flap and the fourth flap are having a second fastener for coupling the third flap with the fourth flap, the method further comprising the step of:

upon wrapping the third flap and the fourth flap, coupling the third flap with the fourth flap.

17. The method according to claim 16, wherein the bottom edge of the cover member is having a pair of cords configured to fasten to the bottom of the stringed musical instrument, the method further comprising the steps of:

upon coupling the third flap with the fourth flap, fastening the pair of cords to the bottom of the stringed musical instrument.

18. The method according to claim 15, wherein the first flap and the second flap are having a fastener for coupling the first flap with the second flap.

* * * * *